US010829949B2

(12) United States Patent
Conklin

(10) Patent No.: US 10,829,949 B2
(45) Date of Patent: Nov. 10, 2020

(54) DRYWALL REPAIR APPARATUS AND METHODS

(71) Applicant: Daniel H Conklin, Gilbert, AZ (US)

(72) Inventor: Daniel H Conklin, Gilbert, AZ (US)

( * ) Notice: Subject to any disclaimer, the term of this patent is extended or adjusted under 35 U.S.C. 154(b) by 0 days.

(21) Appl. No.: 16/249,497

(22) Filed: Jan. 16, 2019

(65) Prior Publication Data

US 2020/0224440 A1 Jul. 16, 2020

(51) Int. Cl.
*E04G 23/02* (2006.01)
*E02D 37/00* (2006.01)
*E04F 13/06* (2006.01)

(52) U.S. Cl.
CPC ..... *E04G 23/0203* (2013.01); *E04G 23/0207* (2013.01); *E04F 2013/063* (2013.01); *E04G 23/02* (2013.01)

(58) Field of Classification Search
CPC ..... E04F 2013/063; E04F 2013/066; E04F 2013/068; E04F 2013/047; E04F 2013/045; E04F 13/002; E04F 13/00; E04G 23/02; E04G 23/0203; E04G 23/0207; E04G 23/0266
USPC ..... 52/514, 514.5, 515
See application file for complete search history.

(56) References Cited

U.S. PATENT DOCUMENTS 2,974,378 A * 3/1961 Lidsky ..... F16B 15/0046 411/467
3,090,088 A * 5/1963 Wood ..... F16B 15/0046 411/467
3,234,841 A * 2/1966 Adams ..... F16B 15/0046 411/467
4,272,804 A * 6/1981 Blum ..... F21V 17/101 248/342
4,574,541 A * 3/1986 Raidt ..... E02D 31/02 52/169.5
5,692,348 A * 12/1997 Ambrosino ..... E04B 1/70 405/43
6,164,868 A * 12/2000 Goughnour ..... E02B 11/005 405/43
6,378,263 B1 * 4/2002 Sobers ..... E04G 23/0207 52/514
6,691,472 B2 * 2/2004 Hubert ..... E02D 31/02 405/107
7,788,870 B1 * 9/2010 Spencer ..... E04D 13/002 52/101
8,615,950 B1 * 12/2013 Gomes ..... E04F 13/04 52/255

(Continued)

*Primary Examiner* — Phi D A
(74) *Attorney, Agent, or Firm* — Lamon Patent Services; Cynthia S. Lamon

(57) ABSTRACT

A backing plate for drywall repair has a body having an outer periphery, and a thickness substantially less than any dimension at right angles to the thickness, made from a semi-rigid material, the body exhibiting two opposite, parallel planar surfaces, a plurality of guiding indentions arranged in a closely-spaced pattern on a first one of the parallel planar surfaces of the body, each guiding indention extending into the body for a first dimension less than the thickness of the body, having an intersection of a first area in the planar surface, and a parallel area diminishing with depth of the guiding indention, and, at the full depth of each guiding indention, a through hole of a diameter centered on the guiding indention and passing through the body and out the opposite planar surface.

7 Claims, 7 Drawing Sheets

(56) References Cited

U.S. PATENT DOCUMENTS

| | | | | |
|---|---|---|---|---|
| 9,540,806 | B2 * | 1/2017 | Lasselsberger | E04B 1/7645 |
| 10,011,990 | B2 * | 7/2018 | Collins | E04F 13/047 |
| 10,145,132 | B2 * | 12/2018 | Wagner | E04G 23/0203 |
| 2002/0139068 | A1 * | 10/2002 | Janesky | E02D 31/06 52/169.5 |
| 2003/0126810 | A1 * | 7/2003 | Brunson | E04B 1/7061 52/169.5 |
| 2006/0101765 | A1 * | 5/2006 | Bailey | E04G 23/0207 52/514 |
| 2009/0084062 | A1 * | 4/2009 | Riggs | E04G 23/0207 52/741.4 |
| 2017/0107729 | A1 * | 4/2017 | Wang | E04G 23/0207 |

* cited by examiner (Section A-A)

DRYWALL REPAIR APPARATUS AND METHODS

BACKGROUND OF THE INVENTION

1. Field of the Invention

The present invention is in the technical area of construction apparatus and methods, and pertains more particularly to repairing damaged drywall.

2. Description of Related Art

Drywall is a very well-known system for finishing walls and ceilings in residences and business buildings. The skilled person will understand that drywall is not very sturdy, and drywall installations are rather easily damaged. Typical damage to a drywall involves a hole or other sort of broken opening of the drywall surface. Repair typically involves providing some sort of backing medium behind the existing drywall, across the opening, and a patch piece of drywall about the size of the boundary of the opening placed against the backing medium and fastened to the backing. Once the patch piece is in place, a compound such as putty may be applied along the seams in order for the surface to appear seamless with the undamaged drywall. The compound is then cured and sanded to make a new, smooth surface, which may then be finished, such as by painting.

Thin wooden slats, such as paint stirring sticks are often used as backing for drywall repair, but are not very sturdy, and tend to split when screws are engaged. Other apparatus and devices are known such as clamps and braces of various sorts, but these are sometimes difficult to work with, are awkward requiring two hands (or more) and may not allow a smooth finish. What is clearly needed are backing plates that are easily installed, work well with drywall screws and that are very sturdy. The present invention fills this need.

BRIEF SUMMARY OF THE INVENTION

In one embodiment a backing plate for drywall repair is provided, comprising a body having an outer periphery, and a thickness substantially less than any dimension at right angles to the thickness, made from a semi-rigid material, the body exhibiting two opposite, parallel planar surfaces, a plurality of guiding indentions arranged in a closely-spaced pattern on a first one of the parallel planar surfaces of the body, each guiding indention extending into the body for a first dimension less than the thickness of the body, having an intersection of a first area in the planar surface, and a parallel area diminishing with depth of the guiding indention, and at the full depth of each guiding indention, a through hole of a diameter centered on the guiding indention and passing through the body and out the opposite planar surface.

In one embodiment the shape of each guiding indention is that of an inverted, truncated pyramid from the first surface to the depth of the guiding indention, comprising four slanted planes converging to the depth of the guiding indention. Also in one embodiment, the shape of each guiding indention may be that of an inverted, truncated cone, having a single converging surface from a first circular area at the first one of the parallel planar surfaces to the full depth of the guiding indention. In one embodiment the material of the backing plate may be a polymer or plastic, for example acrylonitrile butadiene styrene (ABS). This embodiment may also include that diameter of the through hole is provided to be a diameter that will capture the tip of a specific drywall screw.

In one embodiment the body is rectangular, and the guiding indentions are arranged in a Cartesian pattern. In this embodiment, there may seventy-two guiding indentions arranged in six rows of twelve guiding indentions.

In another aspect of the invention a process for repairing a damaged drywall panel is provided, comprising locating a damaged region in the drywall panel, trimming the damaged region and providing a regularly-shaped opening. Using standard drywall screws, securing two or more backing plates on the back side of the drywall panel being repaired. In this embodiment, each of the backing plates comprising a body having an outer periphery, and a thickness substantially less than any dimension at right angles to the thickness.

The backing plates may be made from a semi-rigid material, the body of the backing plate is arranged to include two opposite, parallel planar surfaces, and a plurality of guiding indentions may be arranged in a closely-spaced pattern on a first one of the parallel planar surfaces of the body. This embodiment provides that each guiding indention extends into the body for a first dimension that is less than the thickness of the body. Each guiding indention has an intersection of a first area in the planar surface, and a parallel area diminishing with depth of the guiding indention, and, at the full depth of each guiding indention, a through hole of a diameter centered on the guiding indention passes through the body and out the opposite planar surface.

The backing-plated may be installed projecting substantially into the regularly-shaped opening, cutting a patch-piece of drywall in the shape of the opening, placing the patch piece into the regularly-shaped opening against the backing plates, and fastening the patch-piece to the backing plates with drywall screws from the front, treating with filler material, and sanding as needed.

In one embodiment of the method the shape of each of the guiding indentions of the backing plates is that of an inverted, truncated pyramid from the first surface to the depth of the guiding indention. The truncated pyramid comprising four slanted planes converging to the depth of the guiding indention. Also, in one embodiment, the shape of each guiding indention of the backing plates is that of an inverted, truncated cone, having a single converging surface from a first circular area at the first one of the parallel planar surfaces to the full depth of the guiding indention. In one embodiment the material of the backing plates is acrylonitrile butadiene styrene (ABS). In one embodiment the diameter of the through hole is provided to be a diameter that will capture the tip of a specific drywall screw. In one embodiment the body is rectangular, and the guiding indentions are arranged in a Cartesian pattern. And in one embodiment there are seventy-two guiding indentions arranged in six rows of twelve guiding indentions.

DETAILED DESCRIPTION OF THE INVENTION

Figure 1:
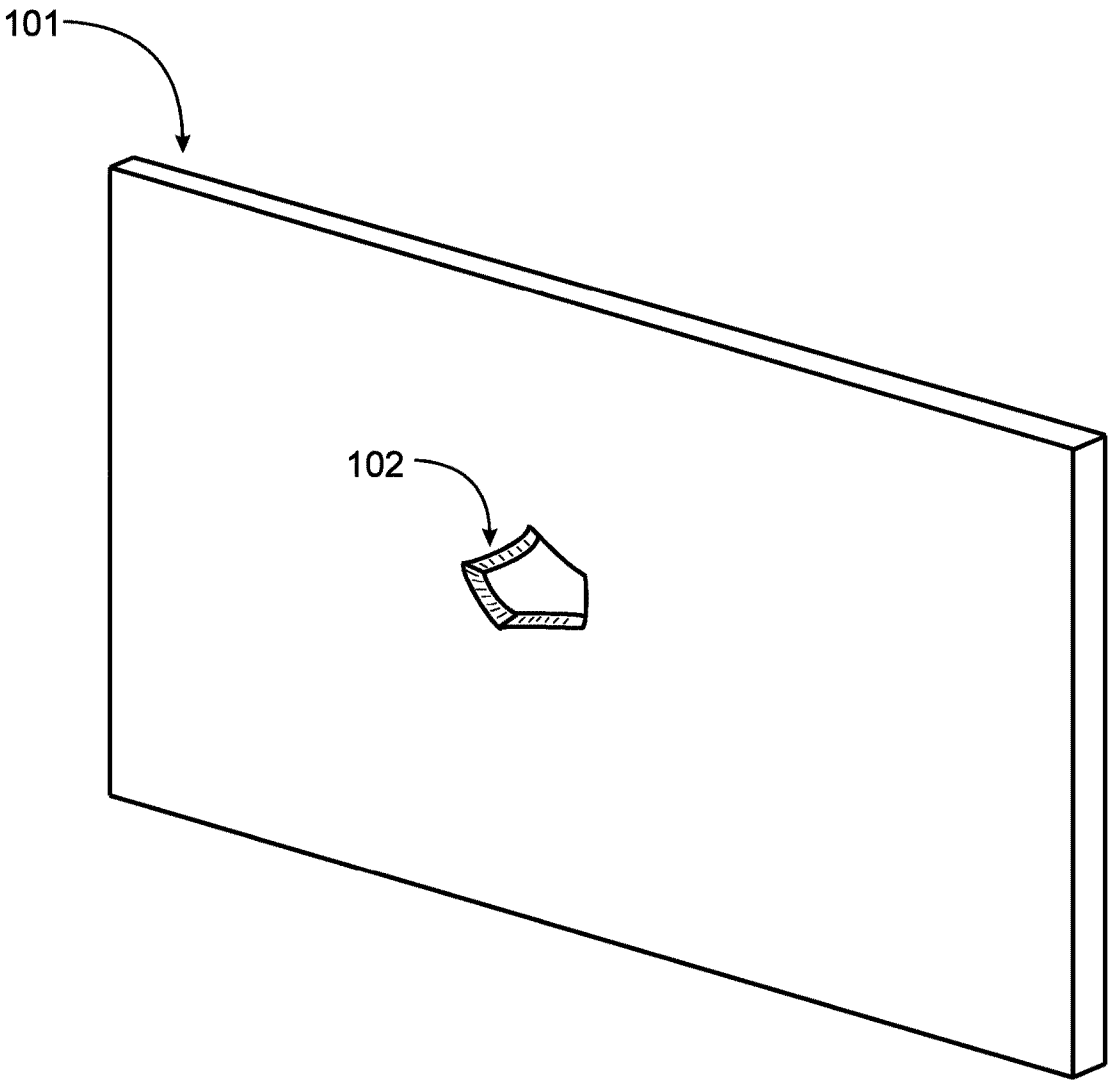
FIG. 1 is a perspective view of a drywall panel showing an area of damage.

FIG. 1 is a perspective view of a drywall panel 101 showing an area of damage labeled 102. Such an instance of damage can take many forms and sizes, and may be caused by any of a large number of circumstances. For example, a worker may have inadvertently struck the panel with a tool of other object. Such damage is typically irregular and leaves pieces of broken drywall hanging from a still-supported panel. It is most often necessary to cut away broken pieces around an area of damage thereby creating a uniform shaped opening in order to effect repair. For example it may be beneficial to cut an opening with straight edges making it easier to cut a like shaped patch to facilitate the repair.

Figure 2:
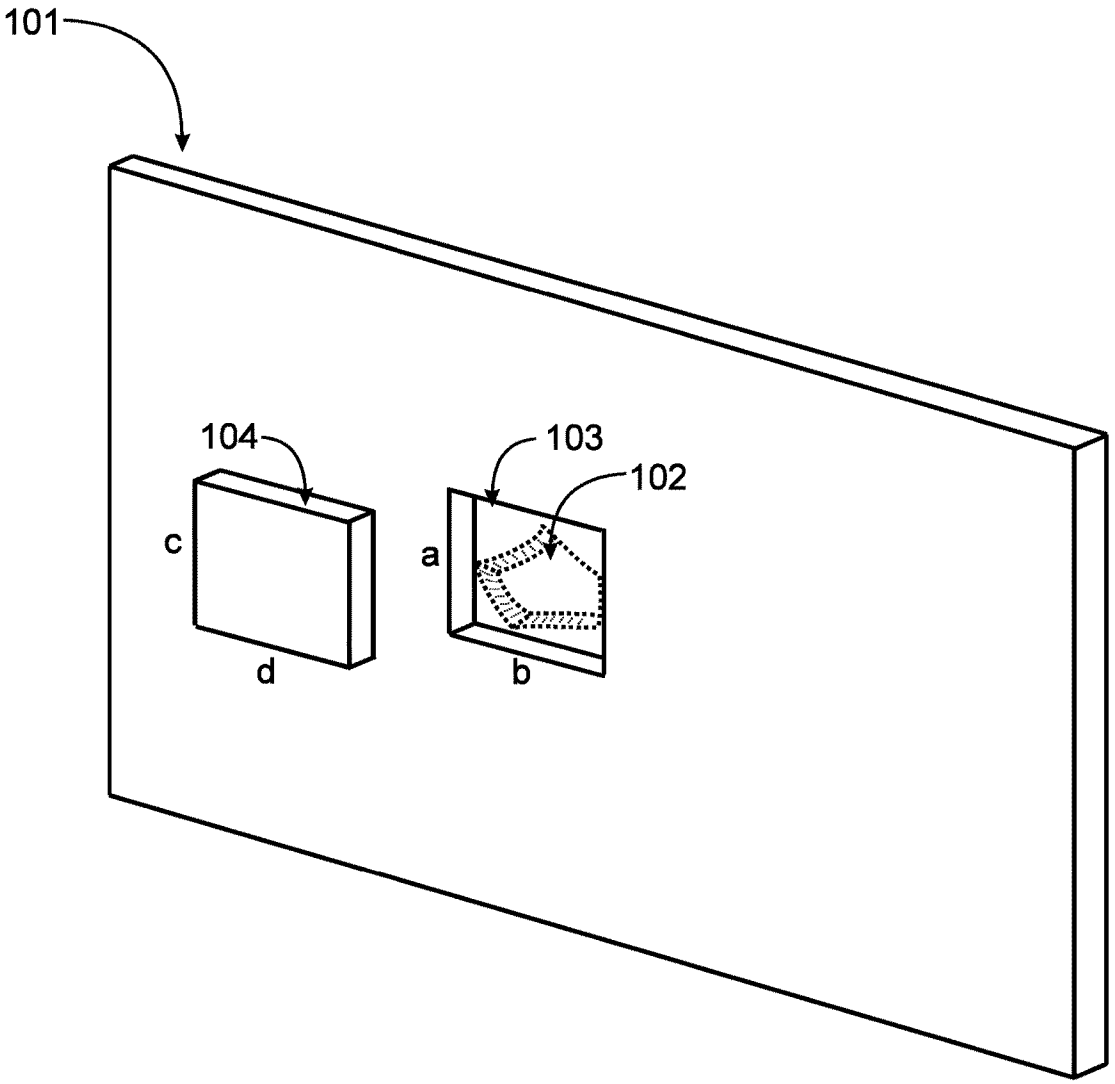
FIG. 2 is a view of the panel of FIG. 1 showing the damage cut away and a patch piece prepared.

FIG. 2 is a view of the panel of FIG. 1 showing the damage cut away to a regular shape 103, and a patch piece 104 prepared. The original damaged area 102 is shown in dotted outline. In this example the regular shape provided is rectangular in shape, having a width b and a height a. Patch piece 104 has a width d and a height c, as well, although the width and height of the patch piece will be slightly less than b and a, because the patch piece needs to fit into the regular shape provided by cutting around the damaged area.

Figure 3:
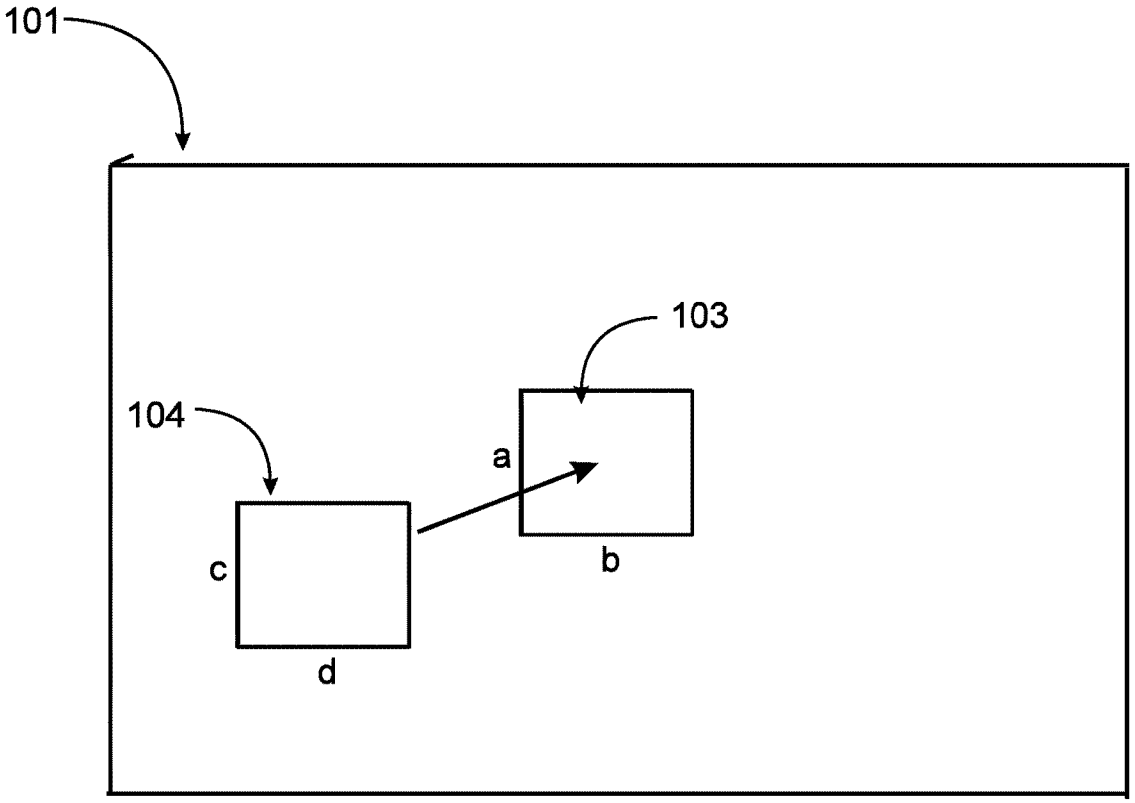
FIG. 3 is a straight-on view of the panel and elements of FIG. 2.

FIG. 3 is a straight-on view of the panel and elements of FIG. 2, with an arrow indicating that patch piece 104 is to be positioned in the cut-away area 103.

Figure 4:
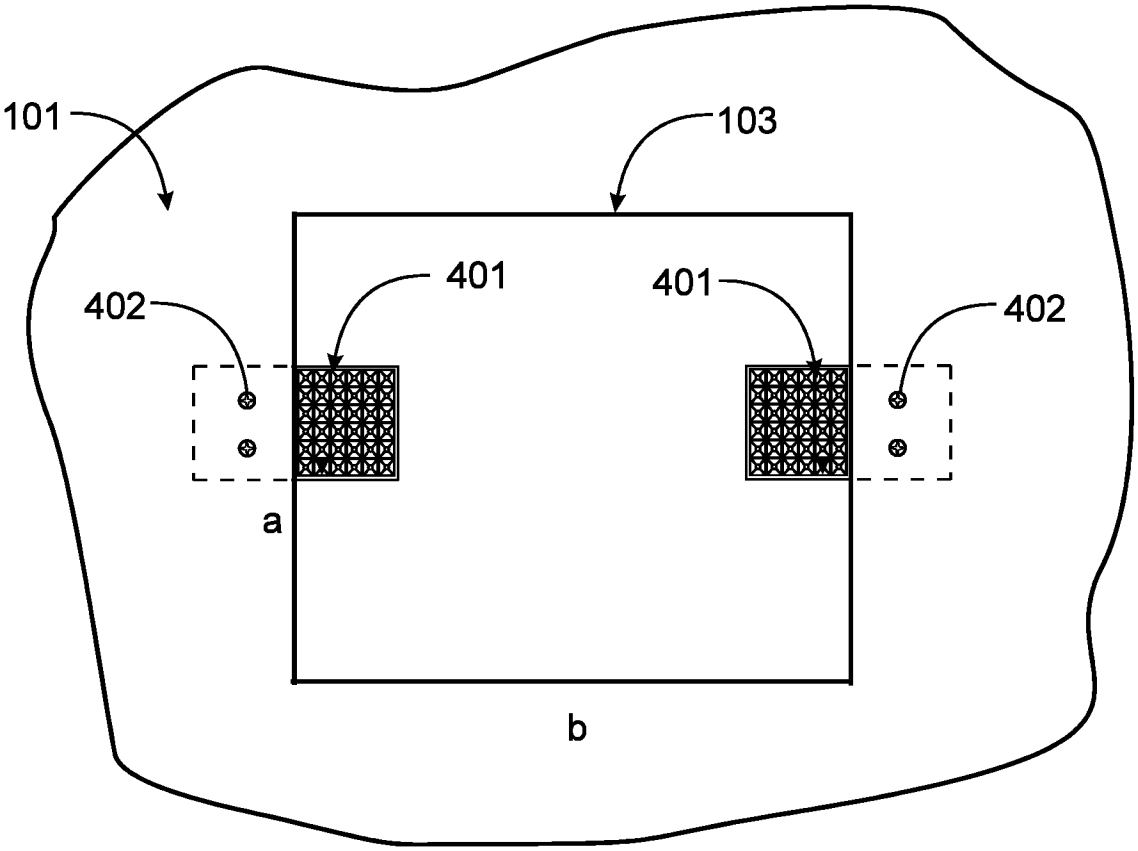
FIG. 4 is a straight-on view of the panel of FIG. 3 with two backing-plates installed in an embodiment of the present invention.

FIG. 4 is a straight-on view of a section of the panel of FIG. 3 with two backing-plates 401 installed in an embodiment of the present invention. Backing-plates 401 are in this example rectangular panels in a planar aspect, having a plurality of pre-formed guide regions for accepting drywall screws, with the pre-formed regions presented in a closely-spaced array, in this case a Cartesian array. Enabling detail of the backing-plates is presented below with reference to FIGS. 5A, and B.

Referring again to FIG. 4, the cut-out region 103 is rectangular as described above, and a backing-plate 401 is installed on each side of the region, with about one-half behind the drywall panel, and the other one-half extending into the region of the cut-out region. A user would, in one process, start a first drywall screw 402 into the drywall panel near an edge of the cut-out region, then place backing-plate 401 through the cut our region, hold it in place, and then drive the drywall screw into the backing-plate using, for example, an electric drill with a Phillips-head bit. As is described below, the drywall screw will be directed into one of the array of pre-formed guide regions, where a hole through the backing plate is sized to accept the tip of the drywall screw, and them drywall screw may be engaged through the hole, pulling the backing-plate tight against the back of the drywall panel. A bit further engagement will counter-sink the head of the drywall screw into the material of the drywall panel.

Once the first drywall screw is set, and the backing-plate is secure, the user may repeat the action and engage a second drywall screw through the drywall panel into the backing-plate, and countersink the second screw as well. The first backing-plate is at this point very securely attached to the back of the drywall panel, with about one-half of the backing plate extending into the cut-out region. Once the first backing-plate is secure, the operation may be repeated to install a second backing plate into the cut-out region on an opposite edge of the cut-out region.

Figure 5B:
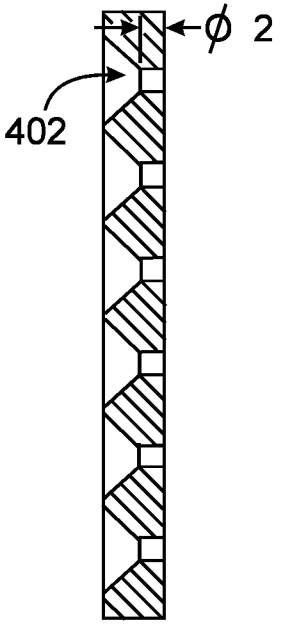
FIG. 5A-5B is a detailed view of the backing-plates of FIG. 4.
Figure 5A:
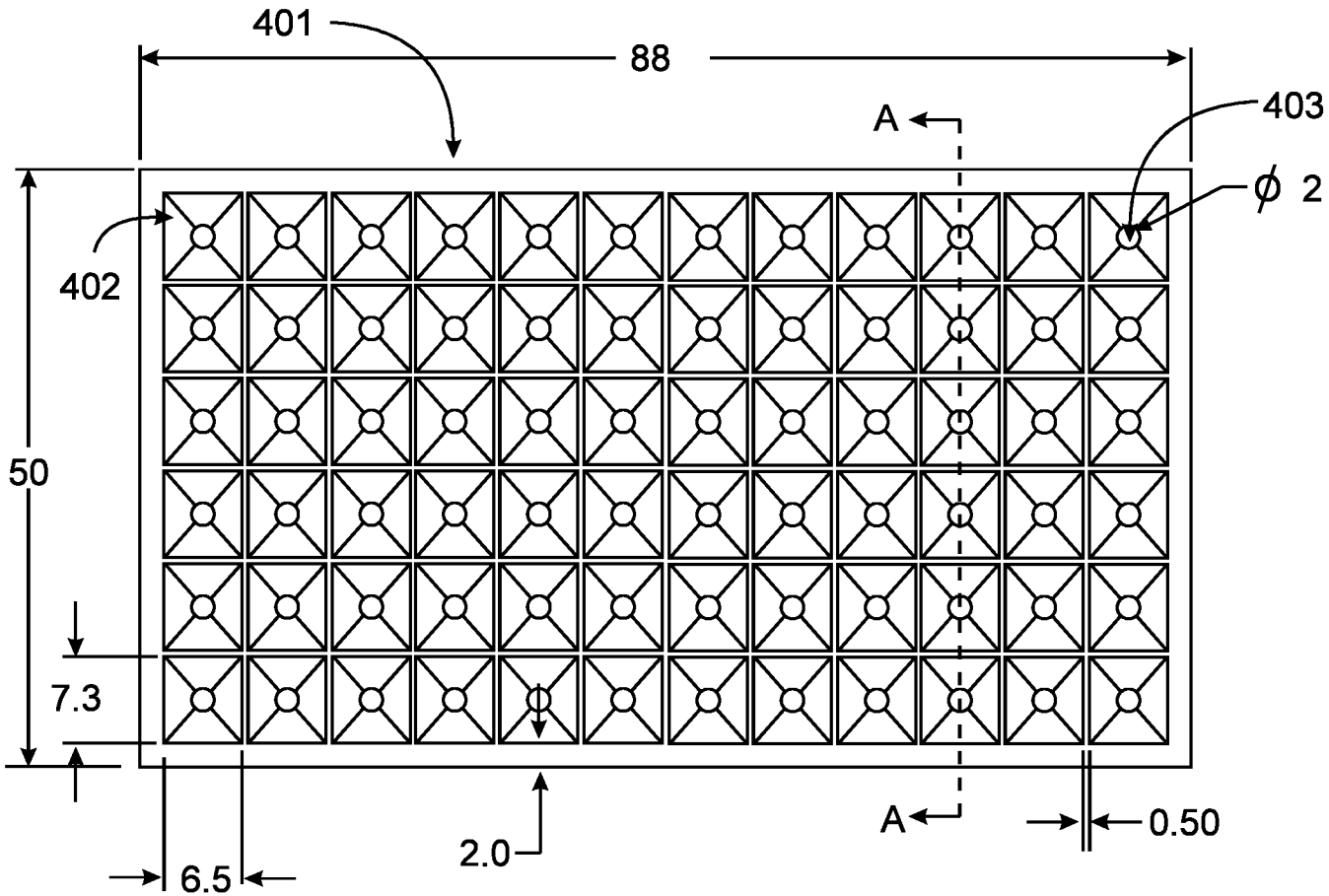

FIGS. 5A, and B illustrate detail of backing-plates 401. All dimensions are in millimeters. Backing-plates according to different embodiments of the invention may take many different forms, but in the embodiment shown in FIGS. 5A and B, backing-plate 401 is a rectangular plastic panel. In this example the backing-plates are manufactured from acrylonitrile butadiene styrene (ABS), which is a thermoplastic polymer that may be heat formed and molded. The dimensions in this example of the overall rectangular package are 88 mm width (about 3.5 inches), 50 mm height (about 2 inches) and 5 mm thick overall (about 0.2 inches, a little less than a quarter of an inch). Materials and shapes of the backing-plate may differ from the present embodiment. For example, the backing-plate may be square or circular in shape and the material used to manufacture the backing-plates may be another semi-rigid polymer other than ABS.

Implemented on one larger surface of the backing-plate, there are seventy-two indentions 402 formed into the backing-plate material, each presenting a square aspect of 6.5 mm on a side (close to one-quarter inch), with a through-hole at the center of 2 mm diameter. The seventy-two indentions are arranged on the panel in six rows of twelve indentions each. As may be seen more clearly in FIG. 5B, which is a section through the panel along section line A-A of FIG. 5A, the indentions are in the shape of an inverted pyramid with a square base, truncated at a depth of 3 mm, where the planar sides of the pyramid shape meet the through hole of 2 mm diameter. The invention is not limited to seventy-two indentions as this number varies with differing sizes of the backing-plates. Additionally, in one embodiment, the amount of indentions may be maintained even though the dimensions of the backing plate are increased or decreased by adjusting a size dimension of each indention in kind with the dimension increase or decrease of the backing plate. Also, an amount of indentions 402 may increase or decrease even though a size dimension of the backing plate remains constant by adjusting the size dimension of the backing plates to a larger size for a smaller quantity and a smaller size dimension to add more indentions 402 to the backing plate.

Referring again to FIG. 5B, one may imagine a drywall screw approaching the backing-plate from the left, with the pint entering into one of the square regions of an indention. If the tip of the screw is not aligned with the through hole 403, it will contact one of the planes of the pyramidal indention. As the screw advances, either the screw will be deflected toward the through hole, or the backing-plate will adjust, so the tip of the screw will reach and engage the through hole. The through hole is sized at 2 mm diameter so the drywall screw will immediately engage and cut threads into the outer diameter of the through hole as it advances further.

A distinct advantage in the backing-plate in embodiments of the invention is that the alignment is automatic, and there is no damage or splitting of the backing-plate, as is often the case with wooden backings. Further, the ABS material, and careful sizing of the through hole enable the backing plate to be very firmly attached to the back of the drywall panel. This advantage is important after the backing-plates are installed, and the patch piece is placed and attached to the backing plates with further drywall screws. The installer doesn't have to be extremely careful, as is the case with most prior art devices and methods.

Figure 6:
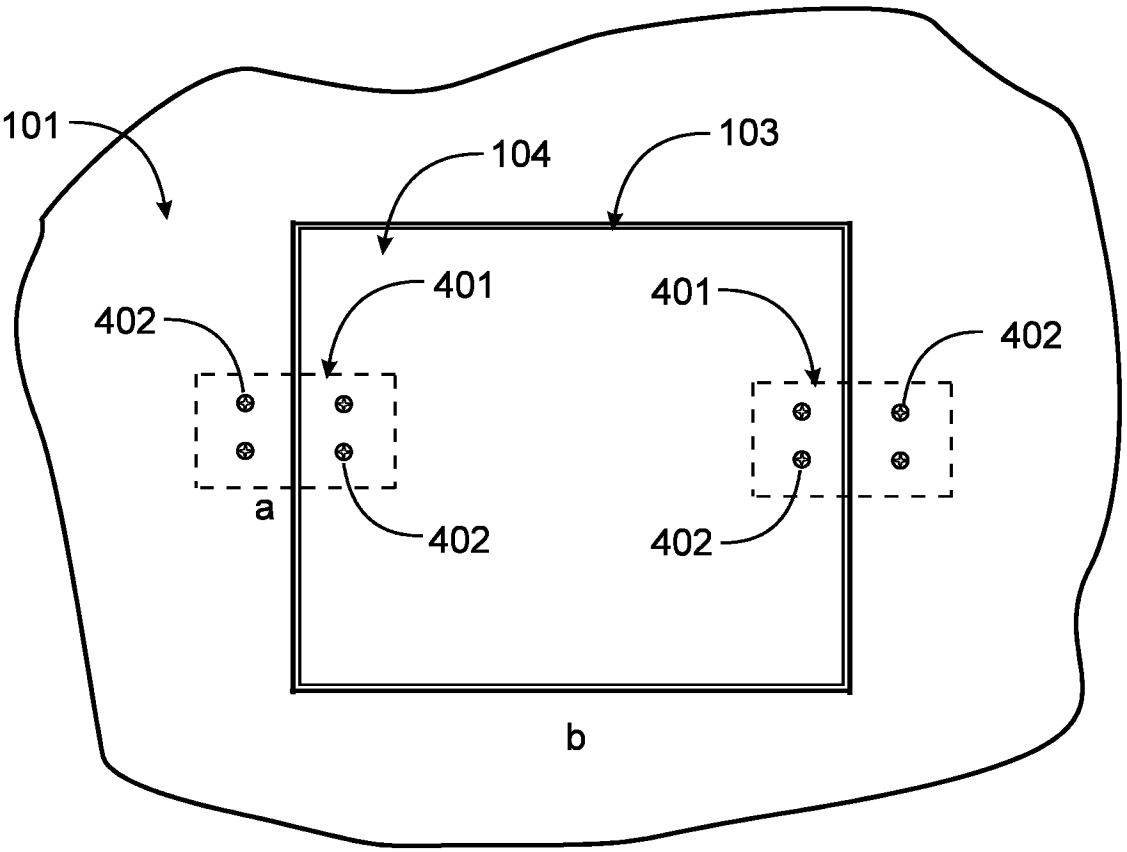
FIG. 6 is a straight-on view of the drywall panel with the patch piece fully installed in an embodiment of the invention.

FIG. 6 is a straight-on view of the drywall panel with the patch piece fully installed in an embodiment of the invention. It may be seen that the repair is now ready for processing using, for example, available pre-mixed plaster or polymer materials for filling the openings along the edges of the patch piece to the drywall panel, and the indentions above the countersunk drywall screws that were used to engage the backing-plates.

It will be apparent to the skilled person that backing-plates according to the invention may take different sizes, and have differing numbers of guiding indentions such as indentions 402. In one embodiment the indentions may be in the form of a truncated cone rather than a truncated pyramid. The cone aspect, however, presents less of a capture area (a circle) than does the pyramid aspect, which presents a square of greater area than the circle. The spacing on the surface of the backing-plate may be different as well, and the backing-plates may be of different shapes and sizes, and may be made of different materials. More or fewer backing plates may be installed, at least partly influenced by the size of a cut out to be closed by a patch-piece.

Figure 7:
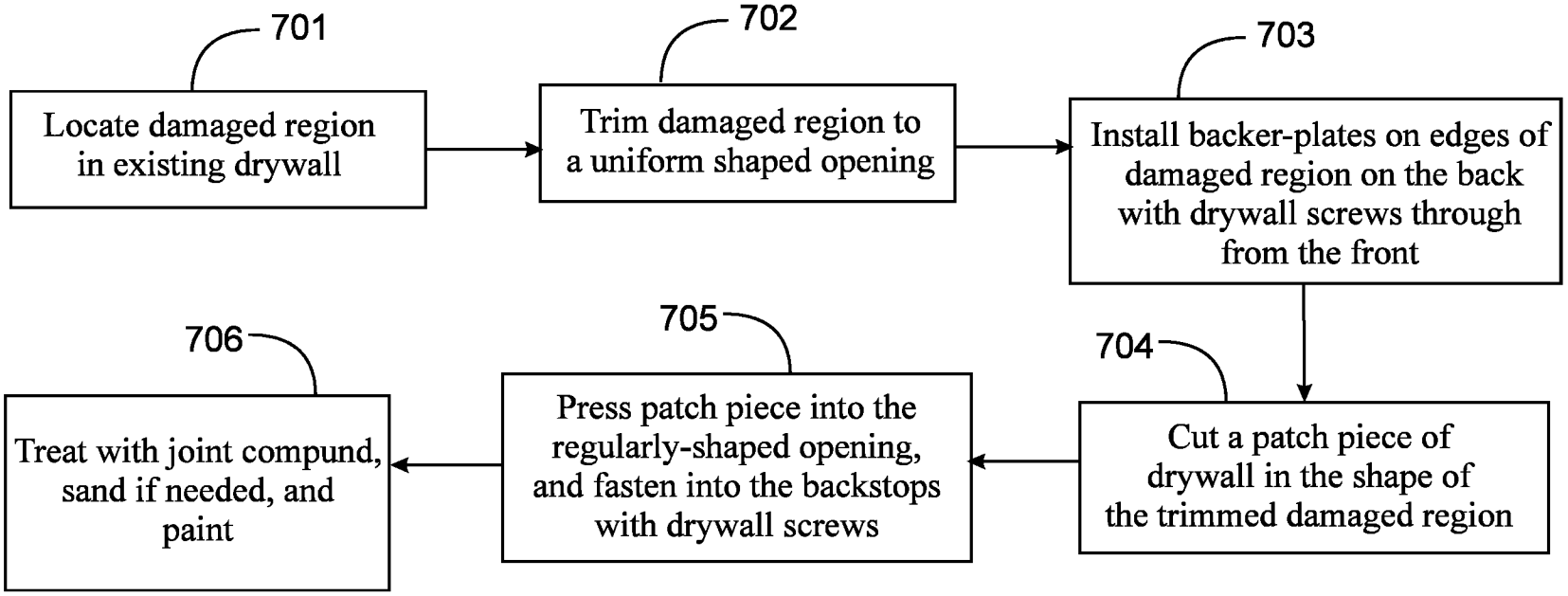
FIG. 7 is a flow diagram depicting a step-by-step process in an embodiment of the invention.

FIG. 7 is a flow diagram depicting a step-by-step process in an embodiment of the invention. At step 701 a user has located a damaged region in a drywall panel. At step 702 the damaged region is trimmed to eliminate any loose pieces, and to form to a uniform shape for the opening. At step 703 backing-plates, according to the invention, are installed along edges of the opening, with drywall screws from the front. Care must be taken to space the wood screws away from the edge of the opening at least 0.5-1 inch at a minimum. At step 704 a patch piece is cut to fit the shape of the opening. At step 705 the patch-piece is placed in the opening and attached with drywall screws through the patch piece and into the backing plates. At step 706 the indentions from countersinking and the regions between the opening and the patch piece are treated with plaster or other polymer materials, which may be sanded to present a smooth surface for painting.

There are some circumstances wherein a vertical orientation of the backing plate will be required when adhering the backing plate along the edges of the cutout portion of the existing drywall. Studs and other obstacles behind the existing drywall may prohibit the vertical orientation seen in FIG. 6.

The skilled person will understand that the embodiments described are exemplary, and that there may be many alterations made within the scope of the invention. The scope of the invention is defined only by the claims below.

I claim:

1. A backing plate for drywall repair, comprising:

a body having an outer periphery, and a thickness substantially less than any dimension at right angles to the thickness, made from a rigid material, the body exhibiting two opposite, parallel planar surfaces;

a plurality of guiding indentions arranged on a first one of the parallel planar surfaces of the body, each guiding indention extending into the body for a first dimension less than the thickness of the body, having an intersection of a first area in the first one of the parallel planar surfaces, and a parallel area diminishing with depth of the guiding indention; and at the full depth of each guiding indention, a circular through hole of a diameter centered on the guiding indention and passing through the body and out the opposite planar surface;

wherein each guiding indention includes four slanted planes converging to the depth of the guiding indention at the circular hole and each guiding indention is directly adjacent to other guiding indentions enabling substantially complete coverage with guiding indentions on the first one of the parallel planar surfaces.

2. The backing plate of claim 1 wherein the shape of each guiding indention is that of an inverted, truncated pyramid from the first surface to the circular through hole.

3. The backing plate of claim 1 wherein the shape of each guiding indention is that of an inverted, truncated cone, having a single converging surface from a first circular area at the first one of the parallel planar surfaces to the full depth of the guiding indention.

4. The backing plate of claim 1 wherein the material of the backing plate is acrylonitrile butadiene styrene (ABS).

5. The backing plate of claim 1 wherein the diameter of the circular through hole is provided to be a diameter that will capture the tip of a specific drywall screw.

6. The backing plate of claim 1 wherein the body is rectangular, and the guiding indentions are arranged in a Cartesian pattern.

7. The backing plate of claim 6 having seventy-two guiding indentions arranged in six rows of twelve guiding indentions.

* * * * *